US008523013B2

(12) United States Patent
Sines

(10) Patent No.: US 8,523,013 B2
(45) Date of Patent: Sep. 3, 2013

(54) ELEVATING LIFT DISPENSER AND CONTAINER FOR ARTICLES IN A LIQUID BATH

(76) Inventor: Randy D. Sines, Spokane, WA (US)

( * ) Notice: Subject to any disclaimer, the term of this patent is extended or adjusted under 35 U.S.C. 154(b) by 1200 days.

(21) Appl. No.: 12/072,551

(22) Filed: Feb. 26, 2008

(65) Prior Publication Data

US 2008/0149661 A1 Jun. 26, 2008

Related U.S. Application Data

(63) Continuation-in-part of application No. 12/008,905, filed on Jan. 14, 2008, which is a continuation-in-part of application No. 11/076,386, filed on Mar. 9, 2005, now abandoned.

(51) Int. Cl.
*B65H 1/08* (2006.01)
*B65G 59/02* (2006.01)

(52) U.S. Cl.
USPC ..... 221/279; 221/254; 221/209; 221/186; 221/135; 221/152

(58) Field of Classification Search
USPC ..... 221/209, 185, 190, 186, 254, 279
See application file for complete search history.

(56) References Cited

U.S. PATENT DOCUMENTS

| | | | | | |
|---|---|---|---|---|---|
| 1,205,026 | A | * | 11/1916 | Rodgers | 99/410 |
| 2,904,205 | A | * | 9/1959 | Callery | 215/391 |
| 3,040,897 | A | * | 6/1962 | Holman | 210/244 |
| 3,380,592 | A | * | 4/1968 | Arnold | 210/244 |
| 3,688,945 | A | * | 9/1972 | Harman et al. | 221/8 |
| 3,850,183 | A | * | 11/1974 | Gruska | 401/78 |
| 4,384,658 | A | | 5/1983 | Large | |
| 4,432,451 | A | * | 2/1984 | Hooser | 206/216 |
| 5,324,126 | A | * | 6/1994 | Holloway et al. | 401/78 |
| 5,337,915 | A | * | 8/1994 | Hall, Jr. | 220/495.11 |
| 5,634,569 | A | * | 6/1997 | DeCoster | 220/735 |
| 5,842,803 | A | * | 12/1998 | Furnell | 401/78 |
| 5,868,266 | A | * | 2/1999 | Nobakht | 220/23.86 |
| 5,883,806 | A | | 3/1999 | Meador et al. | |
| 5,908,139 | A | * | 6/1999 | Pearson | 221/197 |
| 5,918,535 | A | * | 7/1999 | Moreau | 99/413 |
| 6,036,038 | A | * | 3/2000 | Lovelace et al. | 215/391 |
| 6,047,854 | A | | 4/2000 | Demers et al. | |
| 6,092,717 | A | * | 7/2000 | Lowry | 229/120.03 |
| 6,116,407 | A | | 9/2000 | Zolicoffer et al. | |
| 6,745,918 | B2 | * | 6/2004 | Greene | 221/198 |
| 7,191,915 | B2 | | 3/2007 | Hair, III et al. | |
| 7,487,878 | B2 | * | 2/2009 | Giwargis et al. | 220/23.83 |
| 7,544,294 | B2 | * | 6/2009 | Halterman | 210/232 |
| 7,556,167 | B2 | * | 7/2009 | Giwargis et al. | 220/8 |
| 7,767,087 | B2 | * | 8/2010 | Wilson | 210/249 |
| 2004/0148055 | A1 | | 7/2004 | Shoenfeld | |

* cited by examiner

*Primary Examiner* — Michael K Collins
(74) *Attorney, Agent, or Firm* — John S. Reid

(57) ABSTRACT

Containers for contents in a liquid bath, which are resealable and have an elevating lift therein. The lift is preferably operated by an operator that fits within the container. The lift engages both a feature on the operator and a feature on the container. A slope differential exists between the operator feature and the container feature. Rotation of the operator relative to the container results in longitudinal movement of the lift within the container. The lift can be moved toward an upper position to raise at least a portion of the contents out of the liquid bath to facilitate dispensing of the contents.

24 Claims, 14 Drawing Sheets

ELEVATING LIFT DISPENSER AND CONTAINER FOR ARTICLES IN A LIQUID BATH

CROSS-REFERENCE TO RELATED CASES

This is a continuation-in-part of U.S. patent application Ser. No. 12/008,905, filed Jan. 14, 2008, which is a continuation-in-part of U.S. patent application Ser. No. 11/076,386 filed Mar. 9, 2005 now abandoned. Priority under 35 U.S.C. §120 or as otherwise provided by law is claimed. Such prior applications are incorporated by reference entirely. Applicant further reserves the right to withdraw one or more of these priority claims.

TECHNICAL FIELD

The technical field of the inventions relate to relatively small or manually operated dispensing containers having an interior lift for raising contents, particularly foodstuffs, for easier removal by a user.

BACKGROUND OF THE INVENTION

There are a number of different foodstuffs that are provided in sealed containers which have a removable cap that can be remounted to reseal the container. Some of these containers are used to contain manufactured potato chips. As many have experienced, when eating various brands of potato chips which are packaged in this manner, the relatively small tubular size used to laterally contain the potato chips in a stacked configuration is relatively small in diameter and this makes it difficult to manually extract the chips after a portion have been previously removed.

Another problem many people encounter with containers is that as the chips are removed and what becomes the top chip recedes downwardly, the chips become increasingly difficult to grasp. This leads to shaking of the container and upsetting it to obtain the contents. This results in breakage of the chips and then the broken chips are usually poured out onto one's hand and small pieces of the potato chips pass through the hand and onto the floor. This also requires the person eating the last of the chips to hold his or her hand to their mouth. Some might consider this poor etiquette or poor manners. Others just find it sloppy and messy.

Such problems may also exist with other products to an extent that the tubular containers are not favored by the manufacturer. Such products might include corn chips, cookies, crackers, dough, other food items, or even non-food items.

Prior attempts to address these problems have been to shorten the height of the containers. This improves access to some degree, but significantly increases the costs associated with packaging. For example, one company well-known for this type of packaging for potato chips has come out with a six-pack of small containers which are short enough to allow easy access. However, each of these reduced size packages has to be filled, safety sealed and provided with an individual cap and canister. This is demonstrative of the level of ordinary skill in this art. Other approaches may also have been attempted, but to date none has fully addressed the problems to the complete satisfaction of consumers. Concerns about these issues have been expressed for many years to those choosing to package products in this manner. Some manufacturers have not adopted this type of product and packaging because of consumer frustration over the breakage of the theoretically "perfect" potato or other chip or foodstuff.

Thus, there has been a long-felt need in the container art for an inexpensive, and/or manually operated dispensing container that provides better access to remove products or product pieces held in a tubular or other suitably shaped container. This need has been particularly acute where the contents are preferably removed by first removing a container cap which is used to seal the container and protect the sealed contents after such contents have been dispensed.

Some or all of the problems explained above and other problems may be helped or solved by the inventions shown and described herein. Such inventions may also be used to address other problems not set out above or which develop or are appreciated at a later time. The future may also bring to light unknown or currently unappreciated benefits which may be in the future be recognized or appreciated from the novel inventions shown and described herein.

BRIEF DESCRIPTION OF THE DRAWINGS

Preferred forms, configurations, embodiments and/or diagrams relating to and helping to describe preferred versions of the inventions are explained and characterized herein, often with reference to the accompanying drawings. The drawings and all features shown therein also serve as part of the disclosure of the inventions of the current application whether described in text or merely by graphical disclosure alone. Such drawings are briefly described below.

DETAILED DESCRIPTION OF THE PREFERRED EMBODIMENTS

Figure 1:
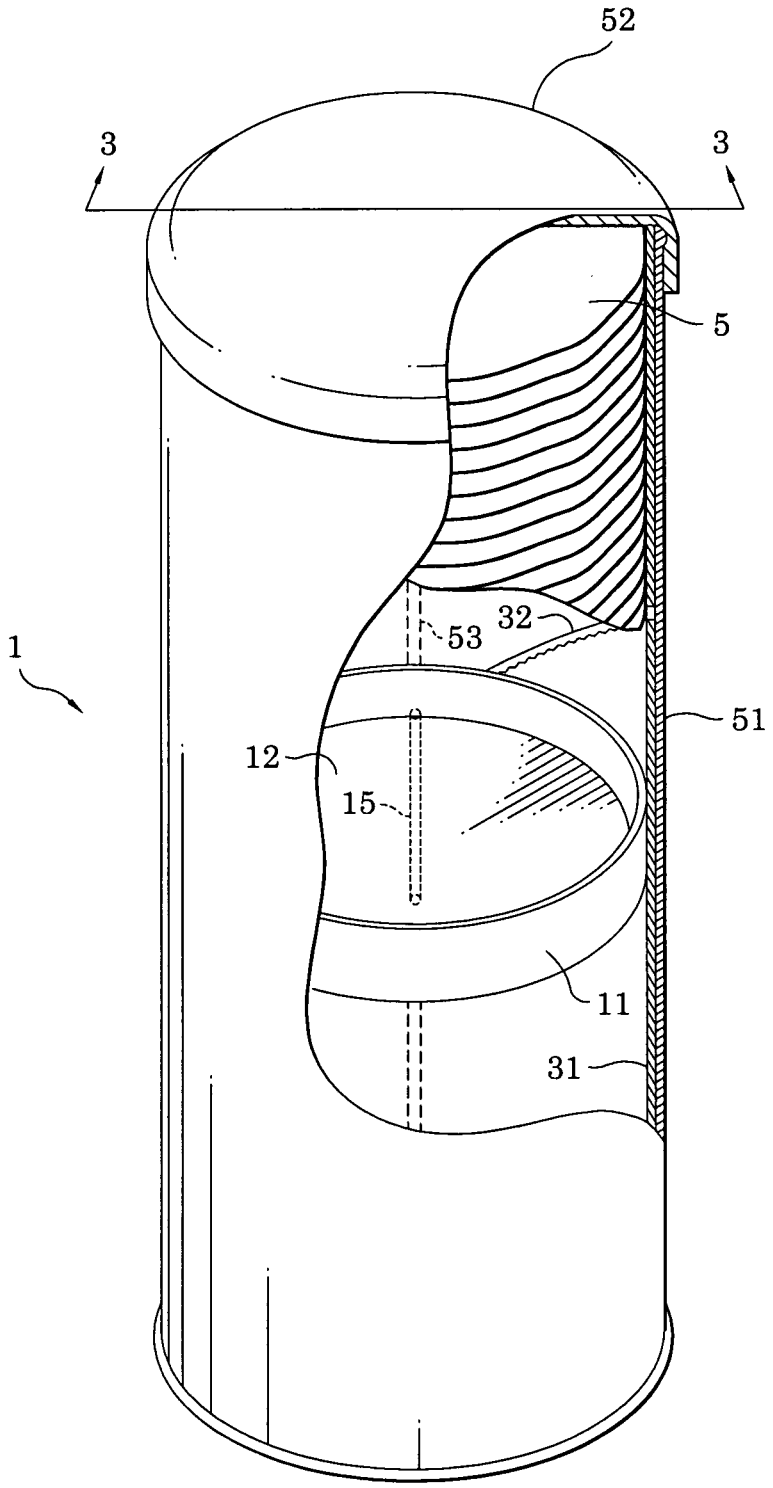
FIG. 1 is a perspective view showing a container having novel features according to the inventions taught herein. A portion of the container has been removed to show additional aspects and features of the inventions.

Table Listing Subsections of Detailed Description
A table of subsections for the detailed description is set out below.
Table of Subsections Table Listing Subsections of Detailed Description
Introductory Notes
First Embodiment and Some Common Features
- General Configuration
- Cannister Portion and Closure Cap
- Lift Assembly
- Lift Operator
- Lift Anti-Rotation Features Second Embodiment
- Generally
- Cannister
- Cap or Closure
- Lift Assembly
- Operator
- Longitudinal Retainer
- Tubular Operator Flexibility Features Third Embodiment
- Plural Camming or Operating Features
- Lift Assembly With Plural Guide Extensions
- Lift Position Indicator Fourth Embodiment
- Operator Tube
- Safety Seal
- Removable Cap Fifth Embodiment
- Cannister
- Cannister Lift Operator Features
- Inner Part or Tube
- Lift More About Methods Performed and Manners of Use
- Methods Concerning Manner of Use
- Manner of Use of Fifth Embodiment More About Preferred Manners of Making
Sixth Embodiment
- Container
- Inner Part or Tube
- Lift
- Manner of Use of the Sixth Embodiment
- More about Preferred Manners of Making the Sixth Embodiment Interpretation Notes

Introductory Notes

The readers of this document should understand that the embodiments described herein may rely on terminology used in any section of this document and other terms readily apparent from the drawings and the language common therefor as may be known in a particular art and such as known or indicated and provided by dictionaries. Dictionaries were used in the preparation of this document. Widely known and used in the preparation hereof are Webster's Third New International Dictionary (©1993), The Oxford English Dictionary (Second Edition, ©1989), and The New Century Dictionary (©2001-2005), all of which are hereby incorporated by reference for interpretation of terms used herein and for application and use of words defined in such references to more adequately or aptly describe various features, aspects and concepts shown or otherwise described herein using more appropriate words having meanings applicable to such features, aspects and concepts.

This document is premised upon using one or more terms or features shown in one embodiment that may also apply to or be combined with other embodiments for similar structures, functions, features and aspects of the invention and provide additional embodiments of the inventions. The readers of this document should further understand that the embodiments described herein may rely on terminology and features used in any section or embodiment shown in this document and other terms readily apparent from the drawings and language common or proper therefor.

Wording used in the claims is also descriptive of the invention and the text of both claims and abstract are incorporated by reference into the description entirely in the form as originally filed. Terminology used with one, some or all embodiments may be used for describing and defining the technology and exclusive rights associated herewith.

First Embodiment and Some Common Features

General Configuration

FIG. 1 shows a preferred embodiment of apparatus or assembly 1 according to some of the inventions set out herein. Apparatus 1 is used for both containing and elevating contents held within a container body to form a combined container and dispenser apparatus. This apparatus is generally referred to by the reference number 1.

The assembly has an outer piece which forms a container body or canister 51 and a removable cap or other suitable closure 52. The cap or other closure preferably snaps onto and off of the open end of the container body or canister. Alternatively, other types of closures having threads, bayonet features or other means adapted for securing the closure to the canister. Additionally, there may be a safety seal (not shown) applied after packing the canister to assure the consumer that the product has not been opened and contents removed, tampered with or adulterated in any manner.

An operator 30 is positioned within the container interior and can be manipulated to allow torque to be applied thereto. The operator preferably has a slot or groove 32 which curves up the side of the operator and engages with a follower 15 extending from the lift. The slot or groove 32 has an upper edge 33 and a lower edge 34. As FIG. 1 illustrates the lower edge 34 may be provided with serrations, teeth or other mechanisms, such as simply friction, to help or prevent the lift from descending after the lift is elevated if such is desired.

The container also preferably includes a longitudinal feature or features which restrict or prevent rotary movement of the end of the follower, thus keeping the lift assembly from rotating with the operator tube. The operator is turned in the appropriate direction and the lift moves upwardly as the follower is pushed up by the helically curved or otherwise appropriately shaped slot or groove. The serrations described above may also be configured and constructed to provide resistance to keep the lift at a given elevation or maintain it at a desired elevation yet allow any retraction into the container which might be desired as depends upon the contents and dispensing and/or sealed containment functions may best be employed.

Canister Portion and Closure Cap

The container 1 has a canister portion 51. Canister 51 is preferably elongated, and more preferably tubular. The tubular configuration is desirably provided with a consistent cross-sectional size and shape. As shown, the canister is cylindrical and can otherwise be suitably shaped to allow operation of the apparatus.

Canister 51 is preferably adapted to engage with a cap or closure 52 to form a substantially sealed interior when the cap or other closure is installed upon or closed with the canister.

Lift Assembly

Figure 2:
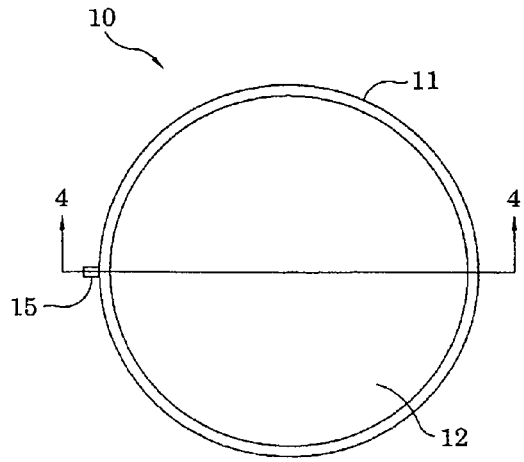
FIG. 2 is a top view showing the interior lift in isolation of FIG. 1.
Figure 3:
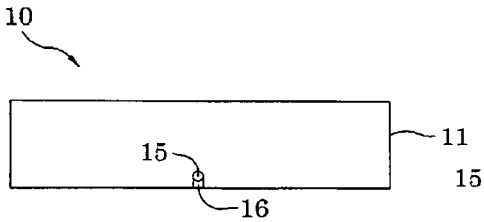
FIG. 3 is a side elevational view of the interior lift of FIG. 2.
Figure 4:
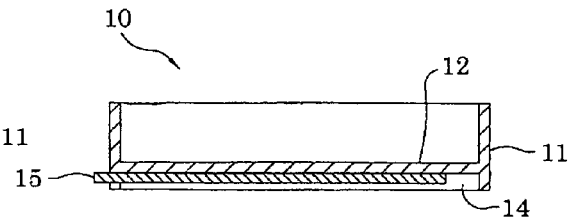
FIG. 4 is front sectional view taken along line 4-4 of FIG. 2.

FIGS. 2-4 in particular show one preferred lift assembly 10. As shown, lift assembly 10 includes a floor 12 surrounded by an annular sidewall 11. The floor 12 supports foodstuffs, such as potato chips 5 as shown in FIG. 1. The annular sidewall helps to maintain proper positioning of foodstuff pieces 5 or other contents and reduces the risk of breakage or other damage. It also facilitates co-linear sliding within the operator, such as operator tube 31.

The lower surface of the floor is preferably recessed to form a lift bottom recess 14. An aperture 16 allows a rod or other appropriately shaped follower 15 to extend from the lift assembly. The follower 15 may be adhered to, otherwise affixed, or be part of the lift assembly. The follower is intended to be maintained within a groove 53 described more fully below.

Lift Operator

The preferred apparatus has an operator 30. Operator 30 advantageously includes an operator feature for moving the lift assembly up and down. As shown, the operator has a feature which forces the follower in response to torque or turning force applied thereto. As shown, such feature is advantageously in the form of a slot 32 or groove formed in the sidewall of the operator tube 31. The slot 32 shown may include serrated teeth or serrations 34 along the lower portions of the slot. The upper edge 33 of the slot 32 may be smooth or otherwise desirably shaped. The extending portion of the lift follower 15 is engaged with the operator slot or other suitable feature, thus moving the lift assembly up or down as the operator tube is rotated.

Figure 5:
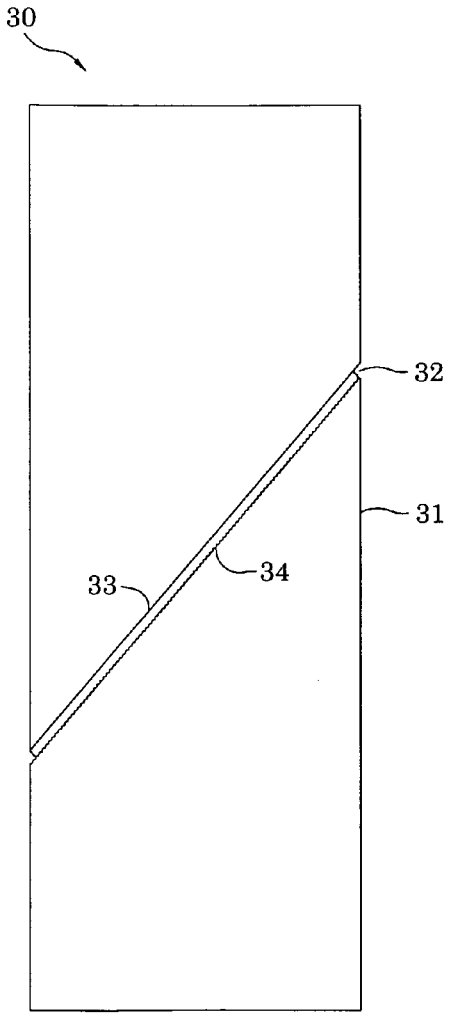
FIG. 5 is rear view of the operator of FIG. 1 in isolation.
Figure 6:
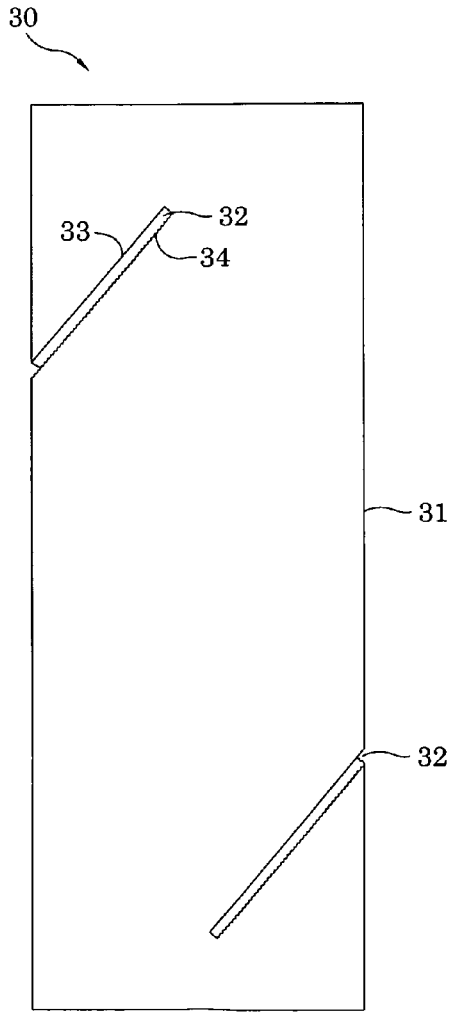
FIG. 6 is a front view of the operator of FIG. 1 in isolation.
Figure 7:
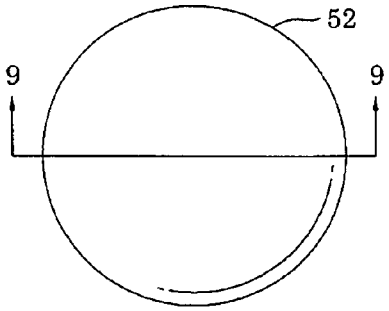
FIG. 7 is a top view of the container structure of FIG. 1.
Figure 8:
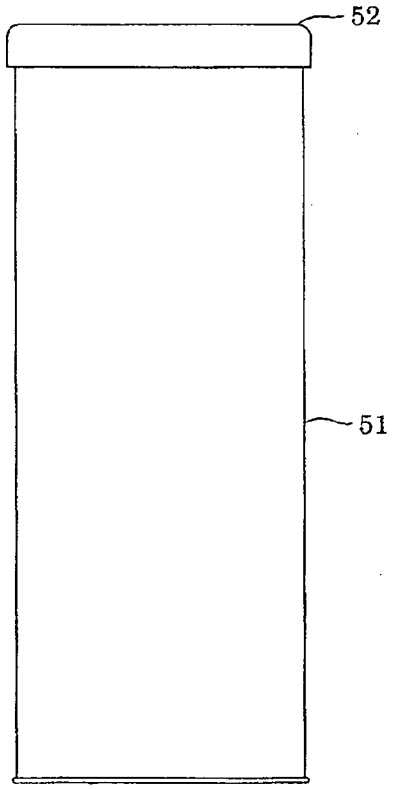
FIG. 8 is a front view of the container of FIG. 1.
Figure 9:
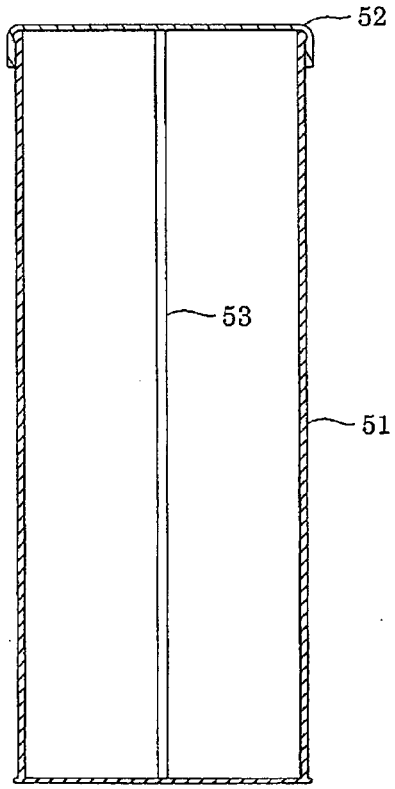
FIG. 9 is a sectional view taken along line 9-9 of FIG. 7.

To facilitate smooth action, the operator is preferably cylindrically shaped as shown in FIGS. 5 and 6 for rotary and/or longitudinal movement within the container interior cavity. Alternative mechanical operators are also possible.

Lift Anti-Rotation Features

Canister 51 advantageously includes a lift anti-rotator in the form of guide feature 53 along an inner or inside wall. As shown, the guide feature is a groove 53 which receives the distal end of the follower 15. The guide keeps the lift assembly from rotating as the operator is turned to raise or lower the lift assembly. This allows the operator slot or groove to move the lift assembly elevationally.

Second Embodiment

Generally

Figure 12:
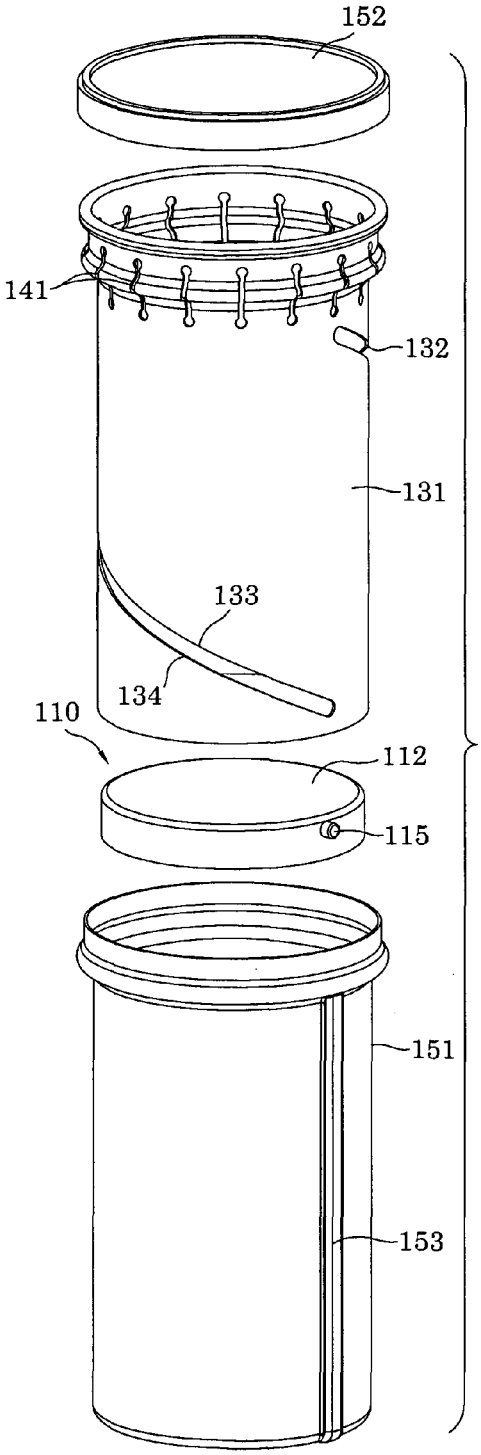
FIG. 12 is an exploded view of a second embodiment implementing features and aspects of the inventions described herein.
Figure 13:
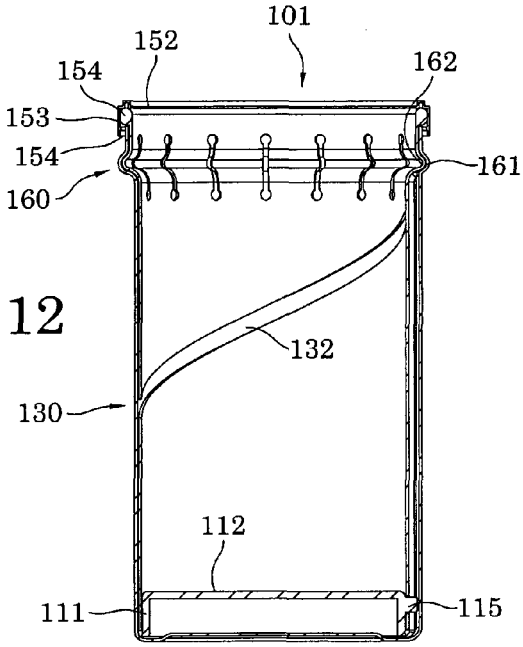
FIG. 13 is a sectional view of the assembled container shown in the embodiment of FIG. 12.

FIGS. 12 and 13 show a second preferred embodiment according to the inventions hereof. Corresponding features used in container and dispenser apparatus 101 are labeled using reference numbers that are the same as used in the first embodiment with an added 100. Thus, such common features to both apparatuses 1 and 101 will not be repeated for sake of brevity. Significantly differing features included in apparatus 101 will now be described in greater.

Canister

Canister 151 is similar to canister 51 but modified by providing a canister groove or furrow 161 that preferably extends about the periphery. As shown, this is implemented by placing the furrow 161 near the upper portion of the canister. The function of this modification is further described below.

Canister 151 also has a guide 153 which is also described in further detail below.

Cap or Closure

FIGS. 12 and 13 show that the cap 152 or other suitable closure is somewhat differently shaped than cap 52. It is advantageously provided with a seal 154. Seal 154 and cap 152 are constructed so as to retain the seal 154 in position within the cap by a peripheral wall having an inward extension 155. Seal 154 is advantageously a flexible or resilient seal which may be made of a variety of suitable materials, in particular food grade elastomeric materials in the form of an O-ring. A variety of suitable materials are known in the art.

Lift Assembly

FIGS. 12 and 13 show a modified lift assembly 110. Lift assembly 110 has a floor 112 which is at or toward the top and with depending side walls 111. The follower 115 extends outwardly and is received in the camming slot 132 in a manner similar to the first embodiment.

Operator

Apparatus 101 operates in a manner very similar to apparatus 1. It differs therefrom with regard to the longitudinal retainer described in detail below. FIG. 12 indicates that the preferred operator is in the form of a camming slot 132 with serrations (not illustrated) along the lower portion 134 of the slot 132. The upper edge of the slot 133 is spaced from the lower portion by a distance that allows the follower 115 to be moved by tubular operator 131. Cam slot 132 forces the lift assembly as the operator tube is rotated.

The follower 115 is held by retainer 160 and thus the lift assembly 110 is forced to move upwardly when properly turned. The lift assembly 110 does not rotate with the tubular operator because of the engagement between follower 115 and the longitudinal retainer 160.

Longitudinal Retainer

Another aspect that the second embodiment differs with regard to the first embodiment is by preferably having a longitudinal retainer 160. The longitudinal retainer helps to retain the operator tube 131 in proper longitudinal position relative to the canister 151. As shown, this is provided by having the canister retainer groove or furrow 161 formed along the interior wall of the canister. In the embodiment illustrated, the retainer furrow is provided by having the canister wall formed to a larger diameter at both the interior wall and exterior wall of the canister. Other configurations may serve to also be suitable.

The longitudinal retainer 160 also includes a projection 162 formed about the tubular operator. Other complementary relationships can also be used relative to the canister and operator to help the longitudinal position to be maintained in a nearly or totally restrained condition to aid operation and also possibly help prevent breakage of the fragile contents, such as potato or other chips.

Tubular Operator Flexibility Features

To allow assembly of the tubular operator into the canister, the upper portion of the operator has not only the projection 162, but also flexibility slots 141. Slots 141 are provided at various circumferential positions to provide the needed flexibility so as to allow assembly of the operator tube 131 into the canister 151.

Third Embodiment

Plural Camming or Operating Features

Figure 14:
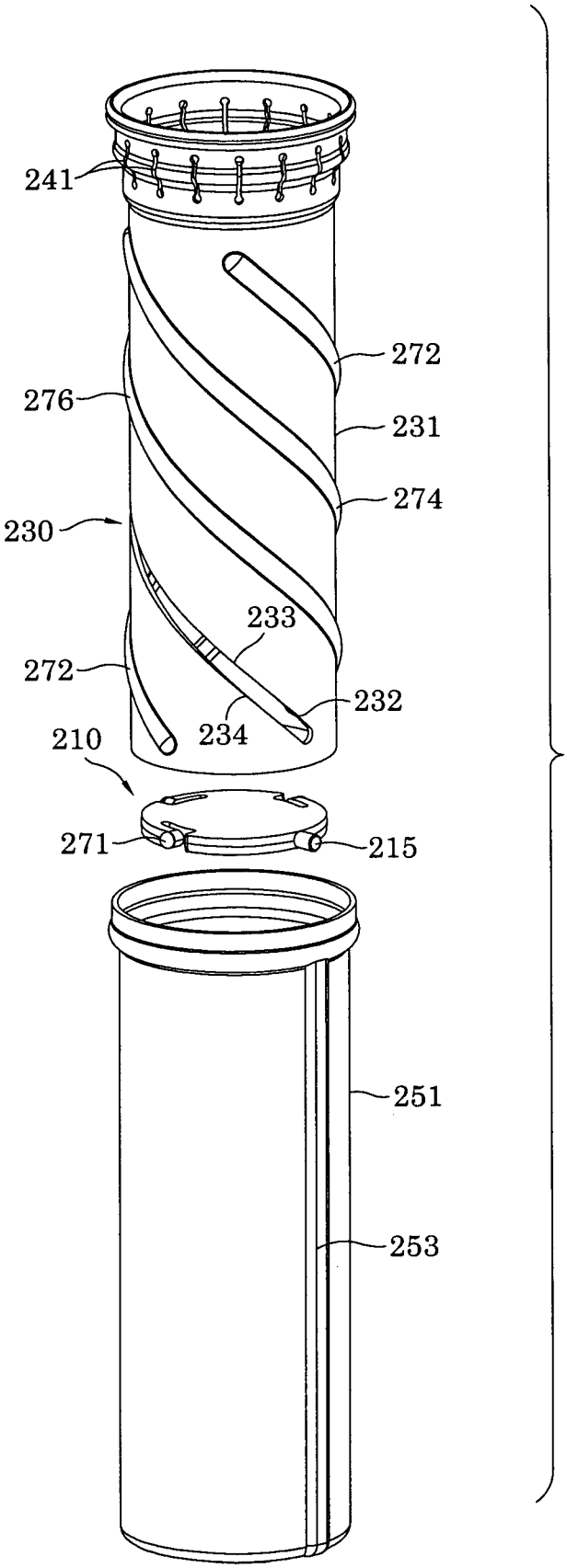
FIG. 14 is an exploded view of a third embodiment implementing further features and aspects of the inventions described herein.
Figure 15:
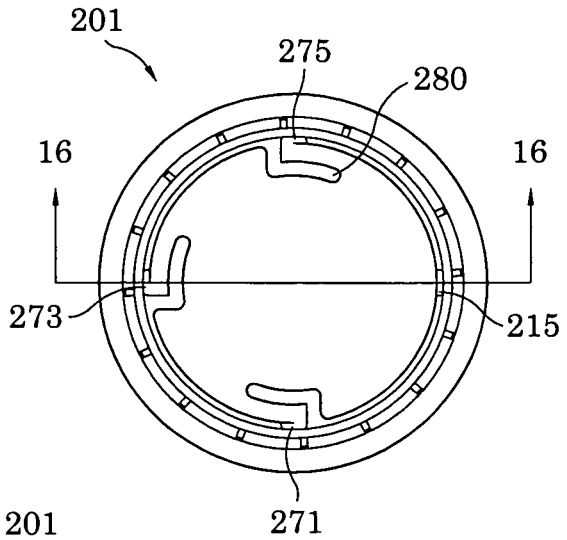
FIG. 15 is a top view of the third embodiment of FIG. 14.
Figure 16:
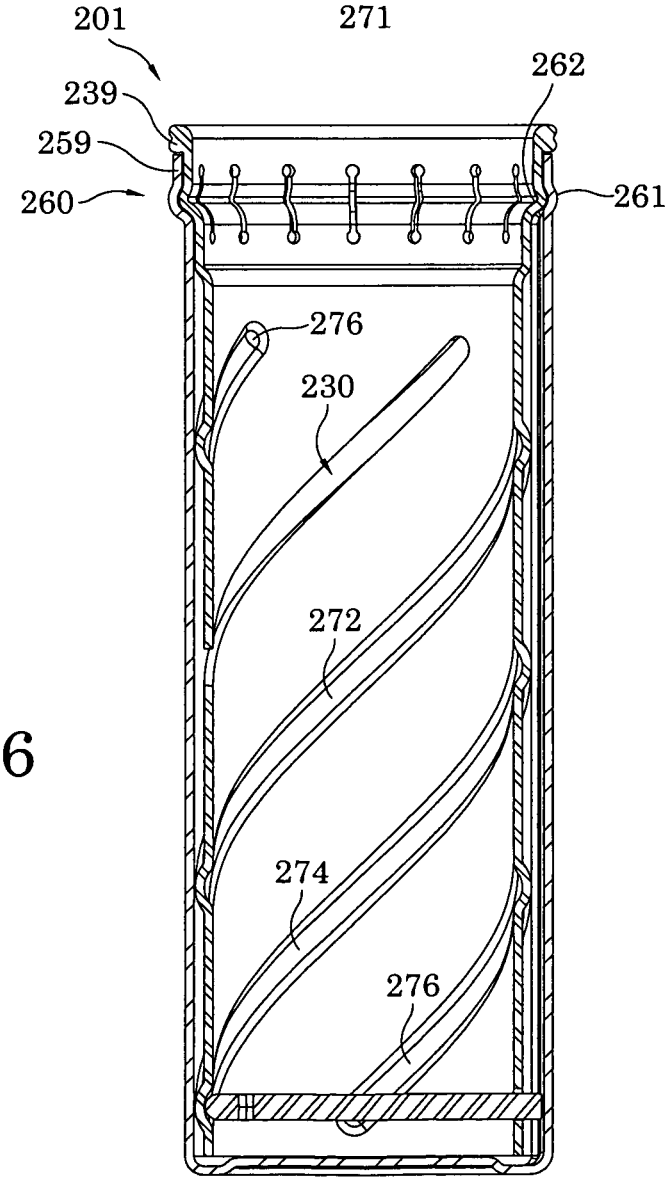
FIG. 16 is a sectional view taken along line 16-16 of FIG. 15.

FIGS. 14-16 illustrate a third preferred embodiment according to inventions described herein. Apparatus 201 is constructed in most respects similar to the second embodiment 101. Similar features with other embodiments are numbered similarly except they have 200 added thereto and therefore not repeated in their description.

The primary differences are with regard to having a plurality of camming features. The plural camming features are used to aid or improve in balanced operation of the lift assembly.

As shown, apparatus 201 has not only a camming or operating slot 232, but also one or more camming or operating features 272, 274 and 276. The features 272, 274 and 276 are in the form of grooves which receive the alignment projections 271, 273 and 275 which are on lift 210. The projection 215 extends through a slot 232 which is open through the operator tube. As the operator is rotated or otherwise moved, then force is transferred from the operator to the lift and the lift is moved upwardly with plural points of force application. The plural points of force application are preferably spaced about the operator and the engagement locations. Even more preferably, the plural points of force application between the operator and lift are approximately evenly spaced, such as at approximately evenly spaced angular positions about the operator when in the form of a tubular operator. As FIG. 15 indicates this is conveniently done at approximately 90 degree angularly spaced positions. Alternatively, other numbers of force application and engagement positions and configurations made be used as is suitable to provide the degree of smoothness is operation as desired.

Lift Assembly with Plural Guide Extensions

FIGS. 14-16 further show that the lift assembly is constructed to provide an anti-rotation extension 215 which is received in a guide tract 253. Additionally, the lift assembly has plural guide extensions 271, 273, 275 at spaced positions about the lift assembly as explained above. As shown the guide extensions are spaced at quarter points of the lift assembly when combined with the anti-rotation extension 215. The plural guides are preferably spaced at approximately equal angular positions. This configuration provides the operator tube with application of force more equally distributed about the lift for smoother operation.

In the preferred version shown, the extensions 271, 273 and 275 extend from mounting arms defined by cutout regions 280. The mounting arms provide dimensional flexibility which facilitate assembly and operation of the lift assembly 210 into and by the operator tube 251.

In another aspect it should be appreciated that by using only one slot 232 and other camming features 271, 273 and 275 which are solid, then the strength and structural rigidity of the operator, such as operator tube 230, can be maintained at a higher strength and rigidity for a given amount of material used.

Lift Position Indicator

FIGS. 14-16 and FIG. 16 in particular shows that the operator tube 230 has an upper end or brim 239 which extends longitudinally beyond the upper end 259 of the canister portion. This extended brim may be marked with a suitable arrow, line or other indicator which is moved relative to a canister indicator on end 259 to provide a visual indication of the approximate relative position of the operator tube in relation to the canister. Exemplary indicator markings can be included that indicate the canister is full, at some intermediate position, or near the top for the convenience of the user.

Fourth Embodiment

Figure 17:
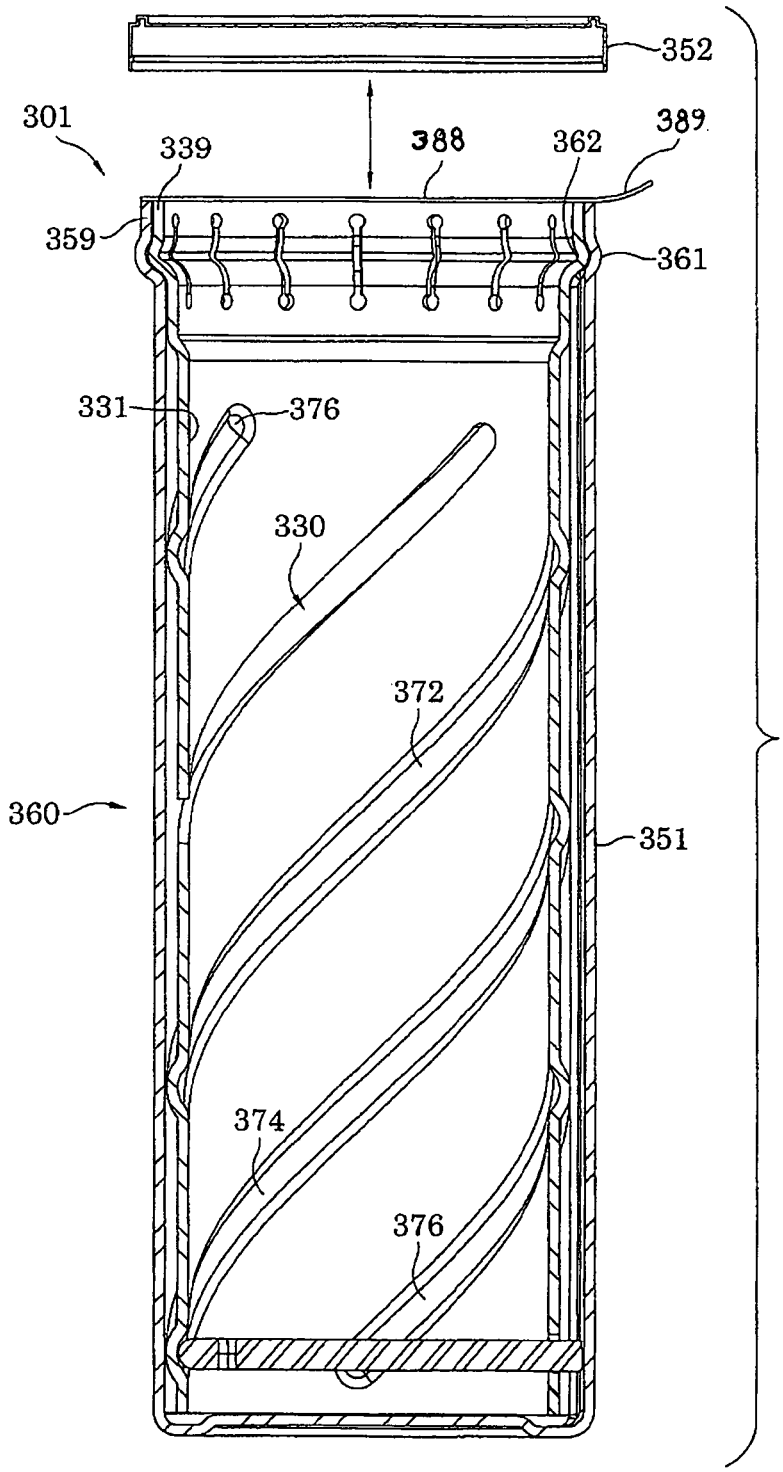
FIG. 17 is an exploded sectional view of a fourth embodiment according to inventions hereof.

FIG. 17 shows a fourth embodiment 301 otherwise like the third embodiment 201 except as described next. Similar features with other embodiments are numbered similarly except they have 300 added thereto and therefore not repeated in their description.

Operator Tube

Fourth embodiment 301 has an operator tube 331 and canister 351 which have top edges 339 and 359, respectfully, which extend about the opening. The top edges are advantageously made so that they are at or nearly equal with regard to their longitudinal position. Thus, the operator tube does not extend outside the canister.

Safety Seal

The fourth embodiment also advantageously includes a safety seal 388 which has a removal tab 389. The safety seal 388 is adhered otherwise suitable attached to the upper ends of the operator tube 331 and canister 351. A removal tab 389 is advantageously included to allow a user to manually grasp the safety seal and pull it from the apparatus to reveal the opening. The safety seal is intended to prevent tampering or adulteration of the contents. It is removed upon initial or first opening and then discarded.

Removable Cap

After the safety seal has been initially removed the cap 352 is used by installing or re-installing it onto the canister and remaining parts of the apparatus to effectively reseal the interior chamber. Cap 352 is removed to allow removal of the foodstuffs or other contents. Removal of cap 352 also allows a user to manually insert the users fingers or otherwise suitable apply force or torque to the operator and thereby operate the lift.

Fifth Embodiment

Figure 18:
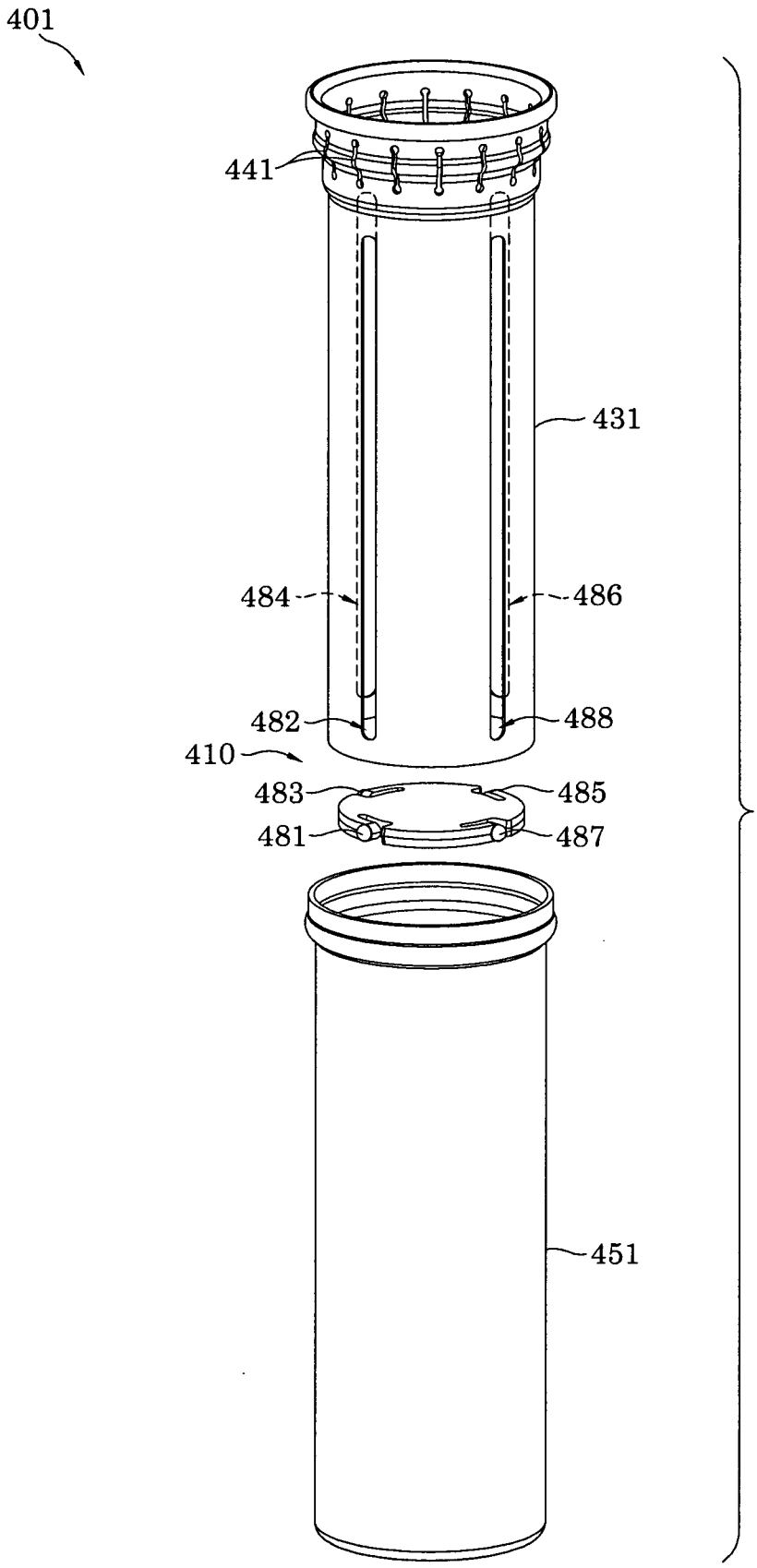
FIG. 18 is an exploded perspective view showing key components of a fifth embodiment according to the inventions hereof.
Figure 19:
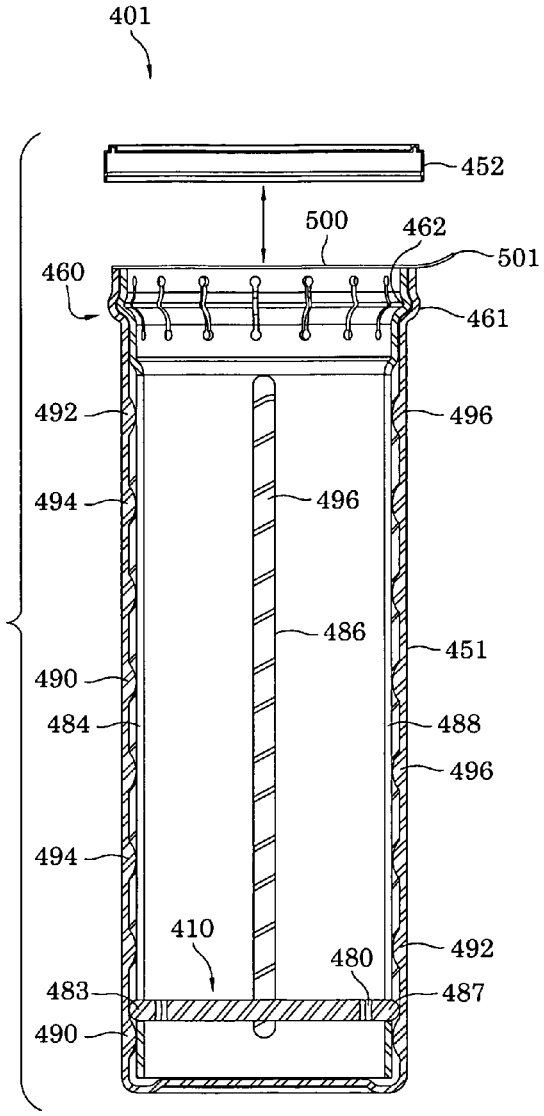
FIG. 19 is an exploded sectional view of the embodiment shown in part in FIG. 18.
Figure 20:
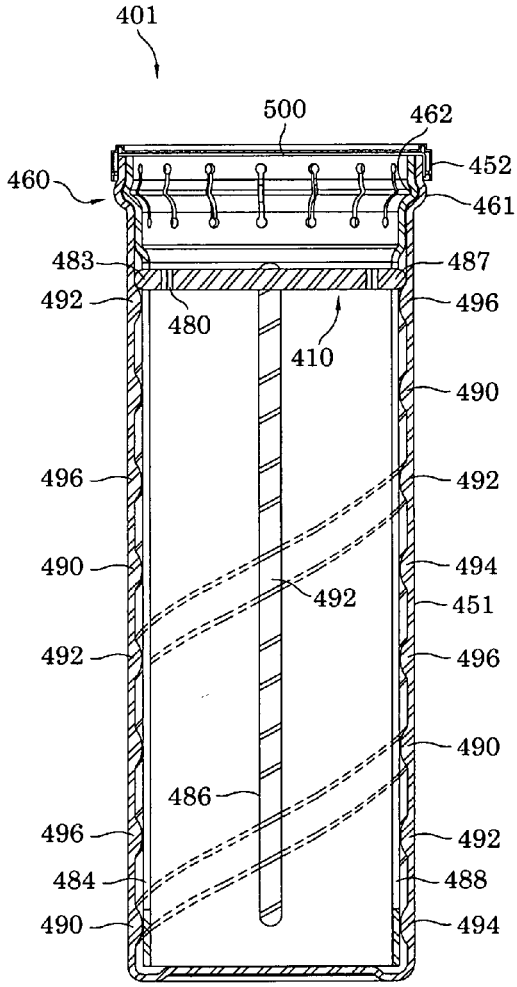
FIG. 20 is a sectional view of the embodiment of FIG. 19 with a cap installed thereon and the lift mechanism moved upwardly relative to the position of the lift as shown in FIG. 19.

FIGS. 18-20 show a fifth preferred embodiment 401 according to inventions taught herein. Similar features with other embodiments are numbered similarly except they have 400 added thereto and therefore not repeated in their description.

Canister

The fifth embodiment apparatus 401 has a lower or canister portion 451 which is similar to the canister 351 of the fourth embodiment. The areas of difference will now be described.

Canister 451 advantageously has a longitudinal restraint feature 461 used to help maintain the relative longitudinal position between canister 451 and the inner member 431. As shown, the inner member has a projecting rib 462 which extends into a receiving furrow 461 as is explained hereinabove in detail.

Canister 451 differs in that it is provided with features that form part of the operator. More specifically, the canister may have and preferably does have features which function as part of the operator used to move the lift 410.

Canister Lift Operator Features

The preferred features of the canister 451 which serve as part of the operator are advantageously used to force the lift 410. As shown, this is advantageously done in the form of inwardly extending features, such as the inwardly extending projections which are shaped to help move the lift longitudinally in response to movement, such as rotation of the inner member or tube 431. As shown, this is done using advancing projections, such as a series of helical projections 490, 492, 494, and 496. Such projections are advantageously formed so as to extend twice around the interior wall of the canister. This configuration can also be considered a four lead interior thread configuration which moves the lift 410 from near the low position to the top position after two relative rotations between the inner part or tube 431 and the outer or canister part 451.

Inner Part or Tube

FIG. 18 shows that the inner part or tube 431 has top features providing the longitudinal retainer 460 as described above specifically the projection 462 that extend into furrow 461 of the outer tube and there are flexibility slots 441 (FIG. 18).

The inner tube 431 is also provided with longitudinal guide slots 482, 484, 486 and 488 which are spaced angularly to receive the projections of the lift 410 which are numbered 481, 483, 485 and 487.

Lift

Contrary to other embodiments the lift in this fifth embodiment provides that the lift 410 rotates with the inner part or tube 431. The lift projections 481, 483, 485 and 487 which are advantageously mounted on flexible arms as described hereinabove. The lift projections extend through the longitudinal slots 481, 483, 485 and 487 and are advanced by the interior helical projections 490, 492, 494 and 496 which are formed on the inner wall of the outer tube or canister. In operation, the inner part and lift rotate together and the lift moves upward such as between the positions of the lift shown in FIG. 19 to an elevated or extended lift position as shown in FIG. 20. The lift 410 can be perforated (480).

More about Methods Performed and Manners of Use

Methods Concerning Manner of Use

Figure 10:
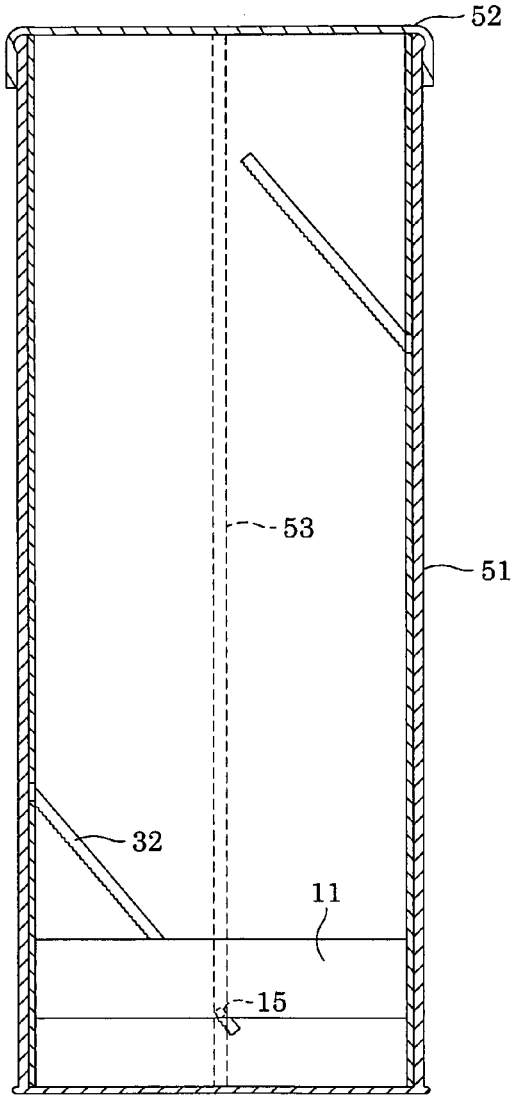
FIG. 10 is a sectional view showing the assembly of FIG. 1 with the elevator lift in a low position.
Figure 11:
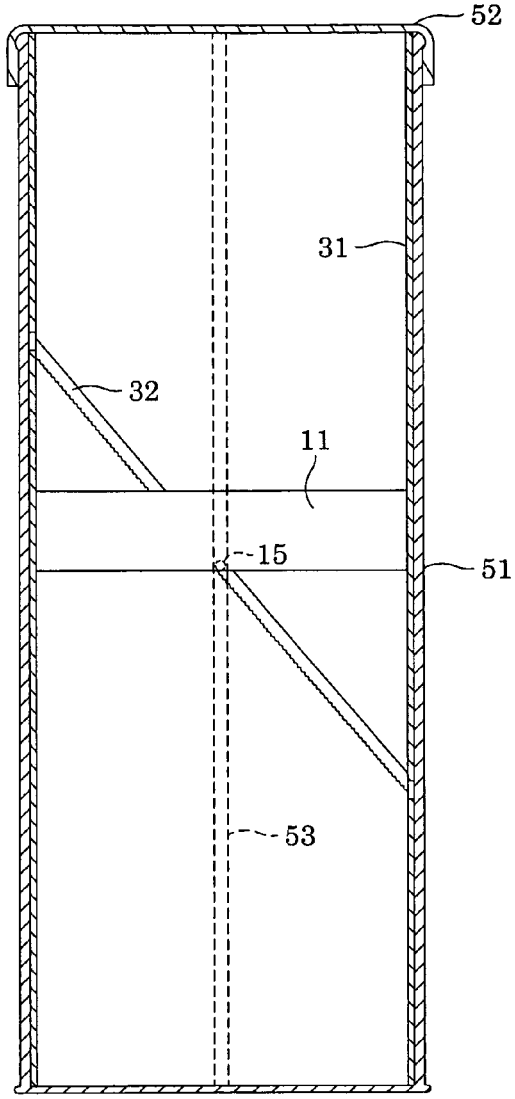
FIG. 11 is a sectional view showing the assembly of FIG. 1 with the elevator lift in a partially raised position relative to the position of FIG. 10.

The invention is typically used by installing the parts into the assemblies shown and described above. FIG. 10 shows the lift assembly relatively low within the canister 51. Cap 52 is removed and the person operating the apparatus 1 applies torque to the operator which turns in response thereto.

As the follower is held against rotating by engaging with the guide groove or other guide feature 52 the apparatus functions as an anti-rotating mechanism. The follower extends through the cam slot 32 formed in the operator, such as operator tube 31. Turning of the operator 31 is performed by applying torque to the operator. This turning action causes the follower to be forced upwardly or downwardly depending on the direction of rotating movement and shape and slope of the cam slot 32.

Operating the apparatus by turning the operator 31 in the proper direction forces the lift assembly upward. This results in elevating the lift assembly and presenting the contents supported upon the lift assembly to a user in a conveniently available position. Thus the apparatus functions by operating the operator which functions by typically elevating the lift assembly and any supported foodstuffs or other contents.

The operating is preferably performed so as to provide positioning of the lift assembly at an elevation wherein the next chip, treat or other contents are near the top opening of the canister. The user then typically uses the device simply by operating the operator, such as by rotating the operator tube by torquing the tube or angularly displacing the operator tube.

Although this is preferably done in a simple, inexpensive manually operated device, other implementations are also possible to perform the desired functions and methods of operation. In a preferred application of use, potato chips 5 or other appropriate foodstuffs, such as cookies, crackers or other items are elevated into position for easy manual grasping and dispensing of the foodstuff or other contents.

Methods according hereto may also include restraining the lift to prevent downward motion. This may be accomplished by using teeth or serrations which preform a catching function. This is advantageously used in preventing the lift assembly from inadvertently dropping within the canister. The maintaining of the lift assembly may be by serrations 34 which retard movement of the follower 15 within the operator slot 32. Alternatively the operator may be prevented from inadvertent movement by properly sizing the operator with respect to the canister to provide frictional restraining of the operator.

As the lift assembly moves up (or theoretically also downward) the follower tends to stay within or against the canister guide feature 53 which performs an anti-rotating function.

Upon removal of the desired contents, the operator can be turned to lower the lift assembly if desired, needed or as allowed depending on the specific embodiment used.

It is noteworthy that the methods are performed with both the contents and operator fully within the inside of canister 51. Thus the methods may further be described as having a opening and closing capability by removing or installing the cap or other closure 52. The cap is preferably held in position by snap fitting the cap over a top marginal rim of the canister to thus provide an enclosing function which acts by sealing or substantially sealing the interior of the apparatus.

Manner of Use of Fifth Embodiment

According to the fifth embodiment the manners of use and methods performed thereby include selecting an assembly having the features described hereinabove with regard to the fifth embodiment. The methods further may include removing any safety seal, such as the illustrated safety seal 500 as may be facilitated by pulling on the tab 501. Once the safety seal has been removed, then the opening of the apparatus is done by removing the cap 452. Conversely, closing or resealing the apparatus is accomplished by installing the cap 452 onto the top of the apparatus and thus substantially sealing or re-sealing the apparatus thus helping by maintaining freshness of the contents and containing them within the container apparatus.

The operational methods performed include rotating the inner part or tube 431 relative to the outer part or canister. This also causes rotating of the lift 410. The lift 410 is adapted and positioned such that rotating the tube 431 and lift assembly results in engaging of the lift engagement extensions relative to the inward features of the outer part or tube. The inwardly directed and preferred helices cause the lift engagement features to advance up or otherwise toward the opening through which the contents can be removed. The relative rotating of the two parts causes in practical use lifting of the foodstuffs upwardly for facilitating manually grasping the foodstuffs.

After the lift has been operated by moving and positioning the lift to a desired position then the user may perform by removing contents. This is usually done by simply engaging the hands and fingers of the user with the foodstuff and extracting them at the convenient position achieved by adjusting the lift height by turning the inner tube relative to the outer tube.

After the user has eaten or otherwise acted by removing or extracting the contents to the degree or extent desired; then, the preferred methods include resealing the apparatus by installing the cap onto the open end and occluding the opening in a substantially sealing relationship.

More about Preferred Manners of Making

Other methods according to the current inventions may include constructing or making or providing a suitable container or containers having the various described features. The container may be made from paper fiber material as is well known in current containers of this type. The making also advantageously includes selecting a canister material that is made by coating or layering the inside, outside or both of the canister with low permeability materials such as aluminum or other metallic coating along the inner wall, outer wall or both. Alternatively, the inner wall, outer wall or both may be made by using other coatings having low air permeability or selecting materials of low permeability to effect maintaining of the flavor of the contents within the container as sold and after resealing with the installing of the cap or other closure.

Alternatively, the apparatuses according hereto may be molded, such as in plastic, glass, appropriate metals according to known techniques. They may also be fabricated from these and other materials indicated above and equivalents thereof. It is currently believed that one suitable form of manufacturing the components of the inventions is by a technique commonly referred to as blow molding. This in particular appears to be appropriate to the inner tube and outer canister. Alternatively, the canister may in some or all forms be made using paperboard or mixtures of a variety of suitable materials used and now known or hereafter developed for the packaging industry and the food packaging industry in most applications.

The making processes may also include positioning the lift assembly made of suitable materials, such as by selecting food grade plastics or paperboard which is either coated or uncoated as needed. The lift assembly is assembled into the apparatus by inserting it into the operator, such as by inserting it into the operator tube as indicated above. The operator can then be further assembled into the apparatus by installing the operator into the canister. Optionally, the apparatus may be assembled by applying a safety seal to perform a safety sealing of the contents until the time of sale.

In the embodiments having a longitudinal restraint construction, the operator is assembled by inserting the operator until the longitudinal restraint couples with the complementary furrow or restraining feature which is advantageously included during the manufacturing of the canister.

Sixth Embodiment

Figure 21:
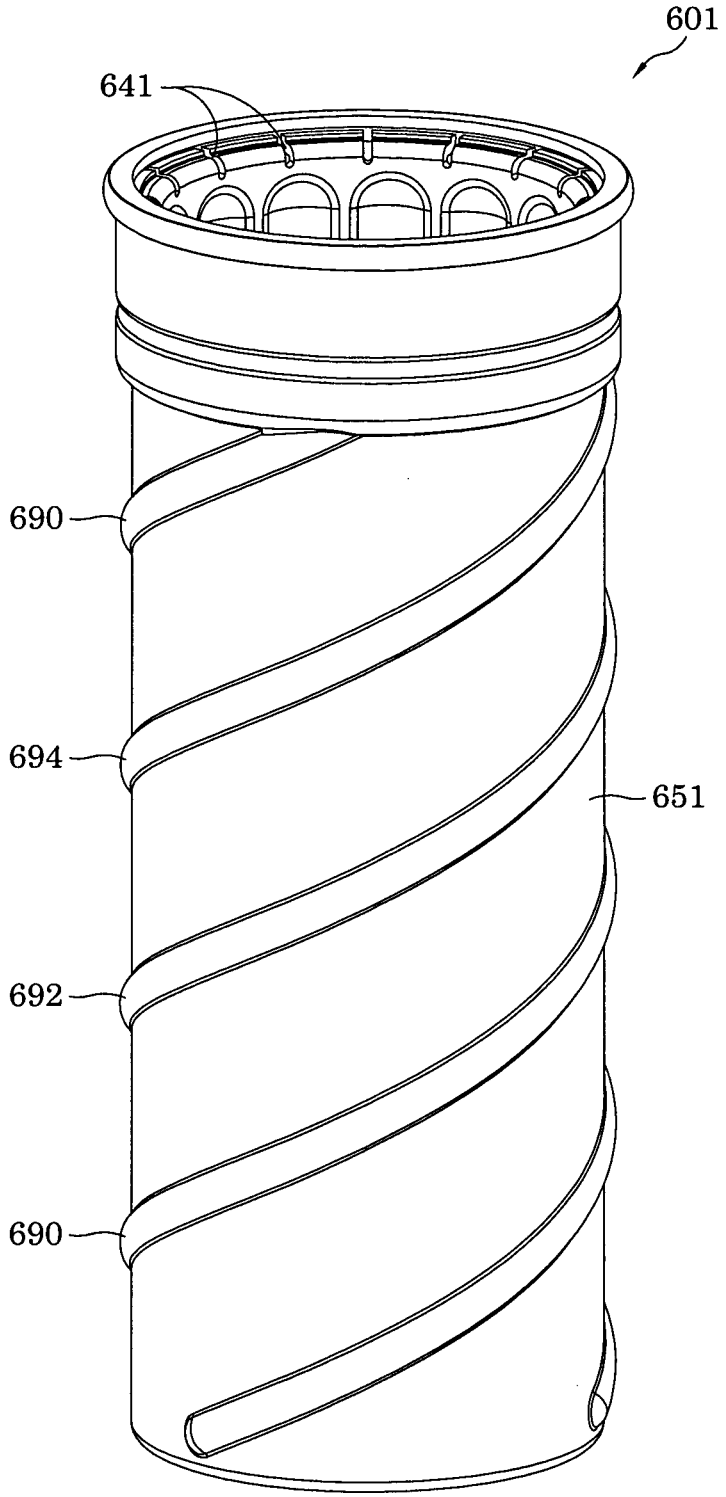
FIG. 21 is a perspective view of a sixth embodiment implementing features and aspects of the inventions described herein.
Figure 22:
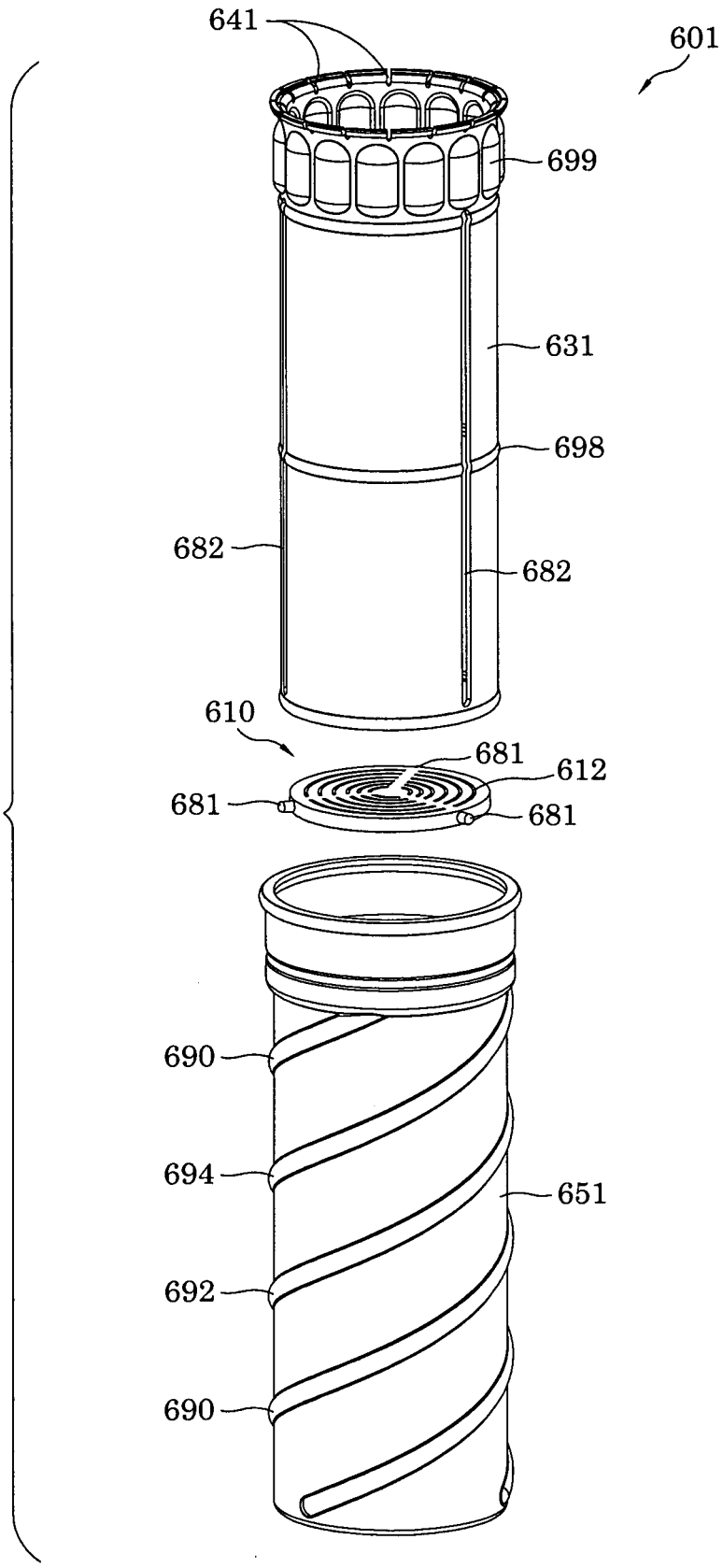
FIG. 22 is an exploded view of the embodiment of FIG. 21.
Figure 23:
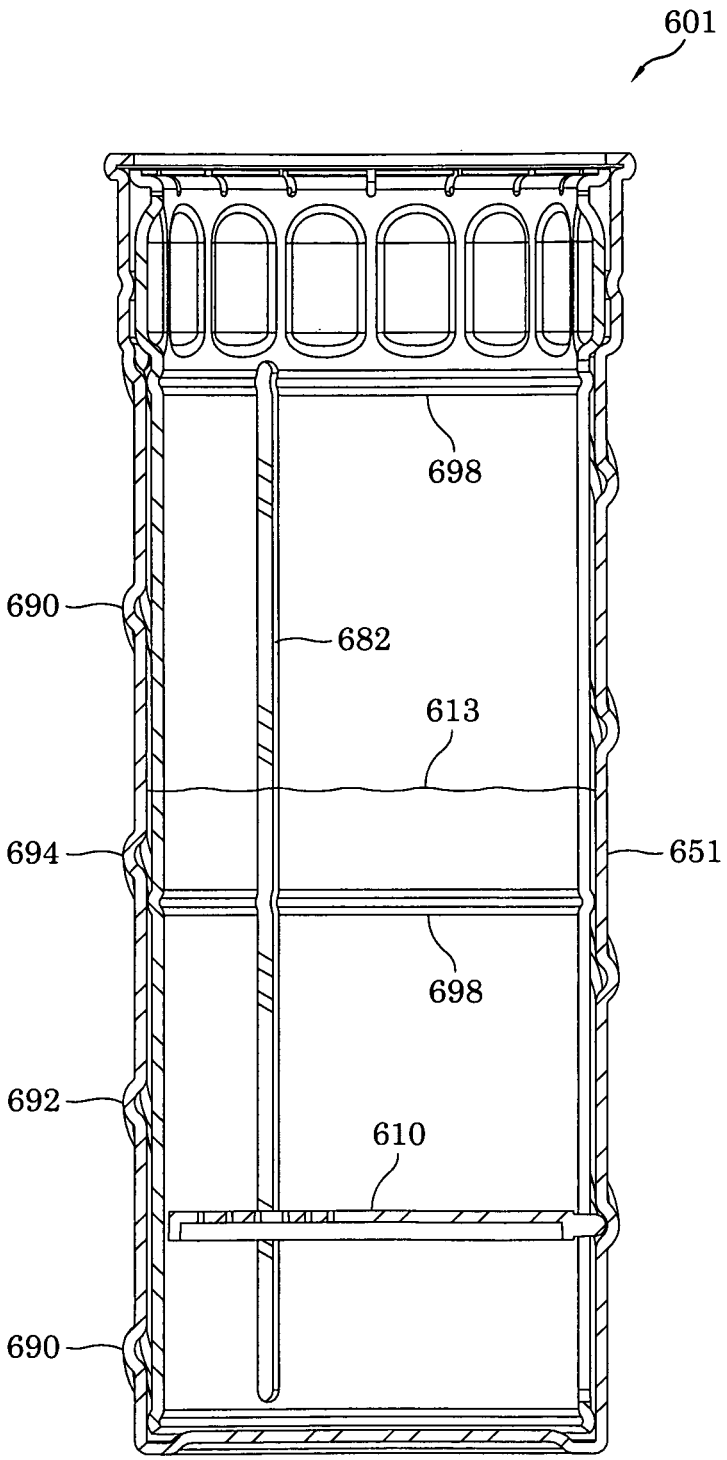
FIG. 23 is a sectional view of the embodiment of FIG. 21.

FIGS. 21-23 show a sixth preferred embodiment 601 according to inventions taught herein. Features of the sixth embodiment similar to those of other embodiments, particularly the fifth embodiment, are numbered similarly except that they have 600 added thereto. Furthermore, description of certain features of the sixth embodiment similar to those of other embodiments are not repeated herein with the exception of certain features notably unique to the sixth embodiment.

Container

The sixth embodiment apparatus 601 includes a container or canister 651 that can be similar to the canisters of other embodiments described herein. For example, the container 651 can be similar to the canister 451 of the fifth embodiment. The areas of difference will now be described.

The container 651 can be adapted to contain or store therein articles such as foodstuffs or the like, which are to be held in a liquid bath. For example, the container 651 can be adapted to store or contain therein pitted olives, stuffed olives, peppers, pickles and the like, which are typically packaged in a liquid brine or other liquid bath suitable for emersion of solid contents. As a further example, the container 651 can be adapted to store or contain therein preserved fruit such as cherries, pieces of pear, peach, pineapple and the like, which are typically packaged in a preserving liquid bath. Other examples of contents of the container 651 include preserved meat products, seafood, or poultry such as pickled eggs, pickled pigs feet, sardines, oysters and the like. It is to be further understood that the contents of the container 651 need not be edible foodstuffs. For example, the container 651 may be suitable or adapted to store inedible objects or articles held in a liquid bath. For example, contents or articles stored or contained in the container 651 can include mineral objects such as jewelry or gems held in a liquid for preserving or cleaning by the liquid bath.

Inasmuch as the container 651 can be adapted for storing contents held in a liquid bath, the container can be advantageously fabricated from a material and/or in a manner so as to render the container at least substantially liquid proof or leak proof. Specifically, the container 651 can be a one-piece leak proof container adapted to contain a liquid therein.

The container 651 can include one or more engagement features 690, 692, 694. One or more of the container features 690, 692, 694 can be adapted to receive therein at least a portion of the lift 610. More specifically, one or more of the container engagement features 690, 692, 694 can be configured to receive therein a respective lift projection 681. In accordance with an exemplary embodiment, the container engagement features 690, 692, 694 can be in the form of cam features as is explained herein with regard to the other specific embodiments. However, it is to be understood that in accordance with an alternative embodiment not specifically depicted, an engagement feature defined on the container 651 can be in the form of a longitudinal feature similar to the longitudinal feature 253 depicted in FIG. 14.

As is depicted in FIGS. 21-23, one or more of the cam features 690, 692, 694 can curve up the side of the container 651. In accordance with at least one embodiment of the present disclosure, one or more of the cam features 690, 692, 694 can curve in an approximate helical shape up the side of the container 651. One or more of the engagement features 690, 692, 694 can be substantially in the form of a groove. More specifically one or more of the engagement features 690, 692, 694 can be substantially in the form of a groove that is molded into the container 651.

One or more of the cam features 690, 692, 694 can function at least substantially in the manner of the canister lift operator features described herein with respect to the fifth embodiment. Specifically, one or more of the cam features 690, 692, 694 can be adapted to engage at least a portion of the lift 610. More specifically, one or more of the cam features 690, 692, 694 can be adapted to help move the lift 610 longitudinally in response to either rotation of the lift or rotation of the inner member 631. Longitudinal movement of the lift 610 can correspond to lifting or raising of the lift toward the container opening.

One or more of the container features 690, 692, 694 can extend at least once around the wall of the container 651. In accordance with an exemplary embodiment of the present disclosure, the container 651 includes a first container feature 690, a second container feature 692, and a third container feature 694. The exemplary embodiment depicted in FIGS. 21-23 can thus be considered a three lead configuration. The depicted exemplary configuration is adapted to move the lift 610 from near the low position to near the top position after slightly more than one relative rotation between the inner part or tube 631 and the container 651.

Inner Part or Tube

FIGS. 22 and 23 show that the inner part or tube 631 can have top features providing a longitudinal retainer 641, which can function and/or can be configured substantially in the manner of the retainer 460 described herein with respect to at least one other exemplary embodiment.

The inner part or tube 631 can be provided with at least one engagement feature 682. The inner part engagement feature 682 can be in the form of a longitudinal guide feature as is depicted in FIGS. 21-23. More specifically, the inner part engagement feature 682 can be in the form of a longitudinal guide slot. It is to be understood, however, that in accordance with at least one alternative embodiment of the disclosure, the inner part engagement feature 682 can be in the form of a cam feature such as depicted in FIG. 14 and as is described herein with respect thereto. In accordance with the exemplary embodiment depicted in FIGS. 21-23, the inner part 631 includes three longitudinal guide features spaced at substantially even intervals about the inner part or tube.

The inner part or tube 631 can include one or more spacing features 698. The spacing feature 698 can provide a slight space or gap between the inner part 631 and the outer container 651, as is evident from a study of FIG. 23. As is also evident, such a space or gap provided by the spacing feature 698 can help to provide a substantially tight fit of the inner part 631 within the container 651 while also substantially avoiding any resistance, binding, interference or the like, which might otherwise occur as the result of surface-to-surface contact occurring between the inner part and container. As shown, there are upper, medial and lower spacing features.

The inner part or tube 631 can include a top feature 699. As is depicted in the exemplary embodiment, the top feature 699 cab be substantially in the form of a series of inward projections arranged about the upper portion of the inner part. The top feature 699 can serve one or more various purposes. For example, the top feature 699 can serve to facilitate grasping or otherwise gaining at least a partial hold on the inner part 631 for the purpose of turning the inner part relative to the container 651. Such turning of the inner part 631 relative to the outer container 651 can result in operation of mechanism to move the lift 610 as is similarly described and depicted herein with respect to the other exemplary embodiments.

Lift

In a manner similar to that depicted and described herein with respect to other exemplary embodiments, the apparatus 601 of the sixth embodiment is configured such that the lift 610 is moved substantially longitudinally between a lower and upper position relative to the container 651. Depending upon the specific configuration of the container 651 and of the inner part 631, such longitudinal movement of the lift 610 can be associated with corresponding rotation of the lift relative to the container, the inner part, or both.

In accordance with the exemplary embodiment depicted in FIGS. 21-23, longitudinal movement of the lift 610 is associated with corresponding rotation of the lift relative to the container 651 and rotation of the lift substantially along with rotation of the inner part 631. The apparatus 601 can be configured such that each of the lift projections 681 engages both a respective longitudinal feature and a cam feature.

More specifically, in the exemplary embodiment depicted in FIGS. 21-23, the apparatus 601 can be assembled such that each of the lift projections 681 is projecting through a respective longitudinal slot 682 in the inner part 631 as well as projecting substantially into a corresponding cam feature 690, 692, 694 in the container 651. Accordingly, when in such a state of assembly, rotation of the inner part 631 relative to the outer container 651 can cause the lift projections 681 to be advanced along each respective cam groove 690, 692, 694, thereby resulting in longitudinal movement of the lift 610 between a lower and an upper position relative to the container. Detailed discussion and explanation of similar lift mechanisms are described herein with respect to the other exemplary embodiments.

As is seen from a study of FIGS. 22 and 23, the lift 610 can have at least one drain opening. This can also be formed of reticulated material. In accordance with at least one embodiment of the present disclosure, the lift 610 can be perforated, wherein the lift 610 can define therein at least one perforation. More specifically, the lift 610 can define a plurality of perforations, openings or apertures therein. As is depicted in FIGS. 22 and 23, the lift 610 can be substantially in the form of a grate or grating having a plurality of curvilinear openings or slits 612 arranged in series of substantially concentric circular patterns. Alternatively, the lift may simply have sufficient clearance about the periphery to allow draining of the emersion liquid 613 (see FIG. 23).

The lift 610 can be configured to support thereon specific or predetermined types of articles, products, or objects, while also allowing liquid to drain through, off, or around the lift. Such a configuration can be advantageous when the apparatus 601 is employed for storing articles in a liquid bath. More particularly, such a configuration can allow at least a portion of the articles supported on the lift 610 and within the container 651 to be raised above the liquid bath by operation of the lift mechanism to facilitate removal of at least a portion of the articles from the container. In accordance with the exemplary embodiment depicted in FIGS. 21-23, a liquid bath is allowed to drain substantially through the lift 610 at least in part because of the lift being configured substantially in the form of a grate or grating having one or more openings defined therein.

Manner of Use of the Sixth Embodiment

The invention is typically used by installing the parts into the assemblies described herein with respect to FIGS. 21-23. A cap or lid (not shown) can be employed with the apparatus 601 generally in the manner described herein with respect to the other exemplary embodiments. A user of the apparatus 601 can unseal the container (not shown) by removing such cap or lid. The user can manipulate the apparatus 601 to rotate the inner part 631 relative to the container 651. Such rotation of the inner part 631 relative to the outer container 651 causing the followers 681 to be forced upwardly or downwardly depending on the relative direction of rotating movement and the slope or shape of the cam features 690, 692, 694.

Operating the apparatus by turning the inner part 631 in the proper direction relative to the container 651 with the assembly 601 in an upright orientation forces the lift 610 in an upward direction. This results in elevating the lift 610 and raising at least a portion of the contents above any liquid bath 613, which may be present in the container to facilitate storage, cleaning, or preservation of the contents. Elevation of the lift 610 can result in presenting the contents supported thereon to a user in a conveniently available position by raising at least the upper portion of the contents out of the liquid bath.

After the contents is lifted in the manner described above to facilitate removal of at least a portion of the contents supported on the lift, the apparatus 601 can then be manipulated so as to lower the contents toward a lower position to at least substantially place the contents back into the liquid bath. This can be accomplished, for example, by rotating the inner part 631 relative to the container 651 in directions opposite those required to move the lift 610 toward the upper position, as described herein above.

According to the sixth embodiment, the manners of use and methods performed thereby include selecting an assembly having the features described and/or depicted herein with respect to the sixth embodiment. The manners of use further may include one or more methods or actions shown and/or described herein with respect to the other exemplary embodiments.

Specific exemplary embodiments associated with the sixth embodiment can include one or more of the following actions. An apparatus such as the apparatus 601 can be selected to have a canister with an opening and a substantially liquid proof interior compartment as well as a lift operator substantially within the compartment, and a removable closure that can be used to open or reseal the canister. The canister can be packed with a liquid bath and at least one article within the liquid bath. The closure can be removed the lift can be operated to move at least a portion of the article above the liquid bath and toward the opening. At least a portion of the article can then be removed from the canister. The canister can be resealed by installing the closure over the opening.

In accordance with at least one embodiment of the present disclosure, the contents of the canister can be a foodstuff held in a liquid bath, which can be a liquid bath for the purpose of substantially preserving one or more characteristics of the foodstuff. In accordance with at least one embodiment of the present disclosure, the lift is substantially reticulated to facilitate drainage of the liquid bath therethrough.

More about Preferred Manners of Making the Sixth Embodiment

Other methods according to the present disclosure may include constructing or making or providing an apparatus in accordance with the sixth embodiment. The container 651, the inner part 631, the lift 610, as well as other components, can be made from a suitable liquid proof material. For example, the container 651, as well as other components, can be made from ceramic, metal, or poly material. The container 651 can be fabricated in a manner to resist leakage of liquid contents. For example, the container 651 can be fabricated according to a process so as to produce a substantially unitary, or one-piece container.

The container 651 and the inner part 631 can be configured and/or made from a material suitable to allow the contents of the container to be viewed from outside the container. For example, the container 651 and the inner part 631 can be fabricated from a substantially transparent material such as various plastic, glass, metal or other suitable materials now known or hereafter developed. A transparent container 651 and/or inner part 631 can be particularly advantageous for use in apparatus 601 marketed or otherwise used as storage devices for one or more various types of foodstuffs because this will allow the foodstuff contents of the container to be viewed.

As an alternative to fabricating the inner part 631 from a transparent material, the inner part can be configured to have little or no sidewalls. For example, the inner part 631 can be fabricated substantially from lengths of metal rod or other materials or provided with openings to reduce materials. Alternatively, the inner part 631 can be fabricated so as to be substantially open to facilitate viewing of the contents of the container.

The container features 690, 692, 694 can be made using any of a number of various means. The container features 690, 692, 694 can be made as part of the container forming process. For example, the container features 690, 692, 694 can be molded into the container 651 when the container is formed by a molding process. Alternatively, the container features 690, 692, 694 can be made after the container 651 is formed. For example, the container features 690, 692, 694 can be formed by routing after the container is formed.

Interpretation Notes

The above description has set out various features, functions, methods and other aspects of the inventions. This has been done with regard to the currently preferred embodiments thereof. Time and further development may change the manner in which the various aspects are implemented. Such aspects may further be added to by the language of the claims which are incorporated by reference hereinto as originally filed.

The scope of protection accorded the inventions as defined by the claims is not intended to be necessarily limited to the specific sizes, shapes, features or other aspects of the currently preferred embodiments shown and described. The claimed inventions may be implemented or embodied in other forms while still being within the concepts shown, described and claimed herein. Also included are equivalents of the inventions which can be made without departing from the scope of concepts properly protected hereby.

I claim:

1. An apparatus forming a selectively sealable container for articles in a liquid bath, comprising:

an outer container having an interior cavity, at least one sidewall, a closed end wall and an open end through which contents are dispensed therefrom;

at least one removable cover which is adapted to seal the container when installed thereon to help preserve the contents;

an operator which is received within the container interior cavity, the operator comprising a sleeve disposed adjacent an inner wall of the outer container;

an interior reticulated lift movable within the interior cavity;

at least one follower forming part of the interior lift, wherein the follower engages a longitudinal feature formed along an inner sidewall of the container;

a helical slot which is defined on the operator for engaging with said at least one follower;

whereby movement of the operator causes the interior lift to move upwardly to raise at least a portion of the articles above the liquid bath to facilitate dispensing thereof.

2. An apparatus according to claim 1 wherein the helical slot has serrations defined along edges thereof.

3. An apparatus forming a selectively sealable container for articles in a liquid bath, comprising:

an outer container defining a liquid proof interior cavity having an inner sidewall, a closed end wall and an open end through which contents are dispensed therefrom;

a removable cover which is adapted to seal the container when installed thereon to help preserve the contents;

an interior perforated lift movable within the interior cavity at least toward the open end;

an operator which is received within the container interior cavity to move the interior lift and any supported contents toward the open end in response to operation of said operator by the user, the operator comprising a sleeve disposed proximate the inner sidewall wall of the outer container;

at least one follower forming part of the interior lift; and wherein the at least one follower engages a longitudinal feature formed along the inner sidewall of the outer container.

4. An apparatus according to claim 3 wherein said operator turns within the outer container.

5. An apparatus according to claim 3 wherein the operator includes at least one cam feature which forces the interior lift to move.

6. An apparatus according to claim 3 wherein the operator has a cam feature in the form of a slot having serrations which curves up a side of the operator and which is also engaged by the at least one follower.

7. An apparatus according to claim 3 wherein the longitudinal feature formed along the inner sidewall of the container is a groove.

8. An apparatus according to claim 3 wherein the operator has a cam feature in the form of a slot which curves up a side of the operator and is engaged by the at least one follower.

9. An apparatus according to claim 3 wherein the operator has a cam feature in the form of a slot which curves in an approximate helical shape up a side of the operator and is engaged by the at least one follower.

10. An apparatus according to claim 3 wherein the operator has a cam feature in the form of a slot having serrations which curves in an approximate helical shape up a side of the operator and is engaged by the at least one follower.

11. An apparatus according to claim 3 wherein:

the operator has a cam feature in the form of a slot which curves up a side of the operator and is engaged by the at least one follower;

the longitudinal feature formed along the inner sidewall of the container is a groove.

12. An apparatus according to claim 3 wherein:

the operator has a cam feature in the form of a slot which curves in an approximate helical shape up a side of the operator and is engaged by the at least one follower;

the longitudinal feature formed along the inner sidewall of the container is a groove.

13. An apparatus according to claim 3 wherein:

the operator has a cam feature in the form of a slot having serrations which curves in an approximate helical shape up a side of the operator and is engaged by the at least one follower;

the longitudinal feature formed along the inner sidewall of the container is a groove.

14. An apparatus comprising:

a canister with a selectively sealable opening;

an operator, wherein the operator is a sleeve which is concentric with, and located adjacent to, an inner sidewall of the canister;

a mechanism within the canister which has an interior lift adapted to support articles in a liquid bath, wherein the mechanism can be operated by way of the operator to raise or move at least a portion of the articles above the liquid bath and toward the opening for access by a user wishing to remove the articles, and the operator has a cam feature in the form of a slot which curves up the side of the operator and is engaged by at least one follower extending from and forming part of the interior lift;

the at least one follower also engages a longitudinal guide feature formed along the inner sidewall of the canister.

15. An apparatus according to claim 14 wherein said operator turns within the canister.

16. An apparatus according to claim 14 wherein the operator includes at least one cam feature which forces the interior lift to move.

17. An apparatus according to claim 14 wherein the slot has serrations which curve up the side of the operator and are engaged by the at least one follower.

18. An apparatus according to claim 14 wherein the slot has serrations which curve in an approximate helical shape up the side of the operator and are engaged by the at least one follower.

19. An apparatus according to claim 14 wherein the at least one follower also engages a longitudinal restraint to resist longitudinal movement of the operator relative to the canister.

20. An apparatus according to claim 14 wherein the longitudinal guide feature formed along the inner sidewall of the canister prevents rotation of the interior lift.

21. An apparatus according to claim 14 wherein:

the slot curves in an approximate helical shape up the side of the operator and is engaged by the at least one follower.

22. An apparatus according to claim 14 wherein said longitudinal guide feature is a groove.

23. An apparatus according to claim 14 wherein:

the slot curves in an approximate helical shape up the side of the operator and is engaged by the at least one follower; and said longitudinal guide feature is a groove.

24. An apparatus according to claim 14 wherein:

the slot has serrations which curve in an approximate helical shape up the side of the operator and are engaged by the at least one follower; and said longitudinal guide feature is a groove.

* * * * *